US005526919A

United States Patent [19]

Ojima et al.

[11] Patent Number: 5,526,919

[45] Date of Patent: Jun. 18, 1996

[54] ESCALATOR APPARATUS AND METHOD OF OPERATION

[75] Inventors: Kazuhira Ojima, Kasama; Chuichi Saito, Katsuta; Kazutoshi Takeda, Katsuta; Toshiyuki Tamatsu, Katsuta, all of Japan

[73] Assignees: Hitachi, Ltd., Tokyo; Hitachi Mito Engineering Co., Ltd., Katsuta, both of Japan

[21] Appl. No.: 459,636

[22] Filed: Jun. 2, 1995

Related U.S. Application Data

[60] Continuation of Ser. No. 319,661, Oct. 7, 1994, abandoned, which is a division of Ser. No. 193,605, Feb. 7, 1994, Pat. No. 5,386,904, which is a continuation of Ser. No. 924,459, Aug. 4, 1992, abandoned.

[30] Foreign Application Priority Data

Aug. 5, 1991 [JP] Japan ..... 3-195224

[51] Int. Cl.[6] ..... B66B 23/12

[52] U.S. Cl. ..... 198/333

[58] Field of Search ..... 198/333

[56] References Cited

U.S. PATENT DOCUMENTS

| | | | |
|---|---|---|---|
| 4,557,369 | 12/1985 | Ishida et al. | 198/333 |
| 4,681,207 | 7/1987 | Goto et al. | 198/333 |
| 5,024,314 | 6/1991 | Kitamura et al. | 198/333 |
| 5,062,519 | 11/1991 | Haruta | 198/333 |
| 5,295,569 | 3/1994 | Kubota | 198/333 |
| 5,332,077 | 7/1994 | Ogimura | 198/333 |

FOREIGN PATENT DOCUMENTS

| | | | |
|---|---|---|---|
| 0013592 | 1/1990 | Japan | 198/333 |
| 0008190 | 1/1990 | Japan | 198/333 |
| 0013594 | 1/1990 | Japan | 198/333 |
| 0100989 | 4/1990 | Japan | 198/333 |
| 2174967 | 11/1986 | United Kingdom | 198/333 |

*Primary Examiner*—James R. Bidwell
*Attorney, Agent, or Firm*—Antonelli, Terry, Stout & Kraus

[57] ABSTRACT

Escalator apparatus of the invention is of the type that has a step whose step board can be raised to provide a surface for carrying a wheelchair. In order to realize conveyance of a large size wheelchair or handcart without changing the installation space for the escalator, the escalator apparatus of the invention is structured such that the step boards of a plurality of adjacent steps are movable upwardly and downwardly.

12 Claims, 9 Drawing Sheets

ESCALATOR APPARATUS AND METHOD OF OPERATION

This application is a continuation application of Ser. No. 08/319,661, filed Oct. 7, 1994, now abandoned, while is a divisional application of Ser. No. 08/193,605, filed Feb. 7, 1994, U.S. Pat. No. 5,386,904, which is a continuation application of Ser. No. 07/924,455, filed Aug. 4, 1992, now abandoned.

BACKGROUND OF THE INVENTION

1. Field of the Invention

The present invention relates to escalator apparatus which may be used not only by general passengers but also by a person on a wheelchair or by a handcart.

2. Description of the Related Art

An escalator apparatus disclosed in the Japanese Utility Model Publication No. 1-9828 must be of an increased height along its entire length for a special truck to horizontally maintain a plurality of steps and for a rail exclusively used to run such a truck. Thus, there has been a problem that it is impossible to modify an existing escalator apparatus to carry a wheelchair.

An escalator apparatus disclosed in the Japanese Unexamined Patent Publication No. 2-8190 has a plurality of steps horizontally arranged from the outset. Thus, in the case where the sloping angle of the escalator apparatus is relatively gentle and the apparatus is to be installed for the same height, its installation size becomes relatively large.

Furthermore, in an escalator apparatus disclosed in U.S. Pat. No. 4,681,207, a wheelchair carrying surface is formed by two steps. It is thus difficult for this escalator to carry a large size wheelchair or handcart.

SUMMARY OF THE INVENTION

An object of the present invention is to provide an escalator apparatus capable of easily carrying a large size wheelchair or a handcart.

Another object of the present invention is to provide an escalator apparatus which is capable of carrying a wheelchair without-changing the conventional installation size thereof.

To achieve the above described objects, the present invention provides an escalator apparatus constructed such that a raising/lowering mechanism for elevating the respective step boards of two adjacent steps to the level of the step board of an upper step which is adjacent the two adjacent steps.

With the construction as described above, it is possible to secure a large horizontal surface for carrying a wheelchair. As a result, it is easy to carry a large size wheelchair or a handcart. At the same time, since ascent and descent of the step boards is performed by the raising/lowering mechanism provided in the steps, it is not necessary to increase the installation size of the escalator apparatus compared with the conventional size.

DESCRIPTION OF THE PREFERRED EMBODIMENTS

Figure 1:
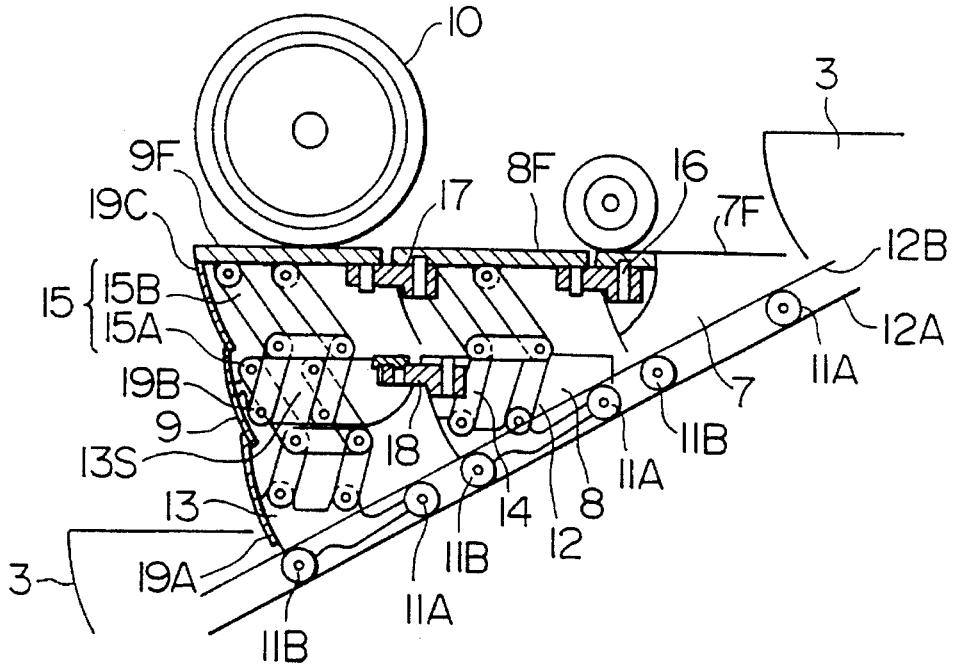
FIG. 1 is a partially sectional side view of a part of an escalator apparatus according to the present invention with the apparatus shown in operation.
Figure 2:
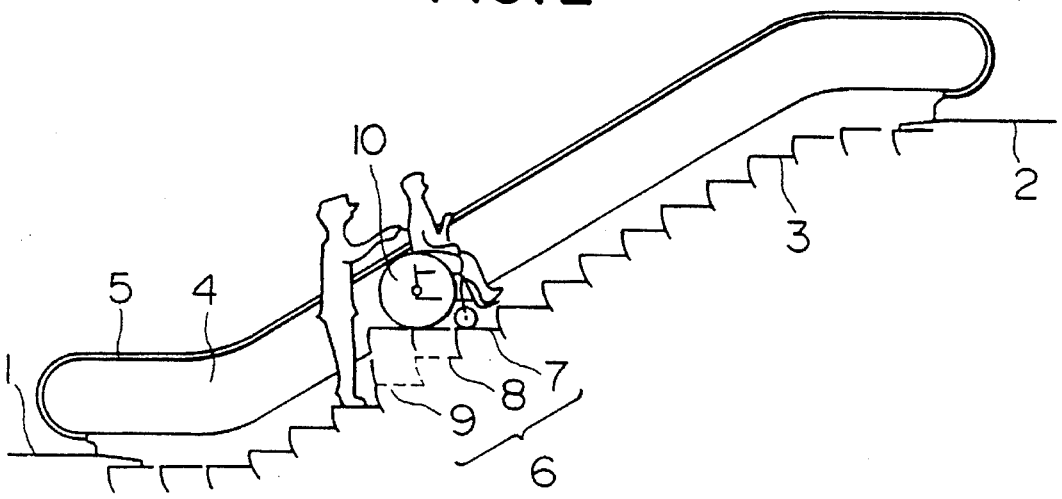
FIG. 2 is a schematic side view of the escalator apparatus according to the present invention showing entire operative modes thereof.

As shown in FIG. 2, the escalator apparatus according to the present invention has a plurality of steps 3 connected together to form an endless loop arranged to extend and driven to run between a lower entrance/exit 1 and an upper entrance/exit 2 which are provided on a lower floor and an upper floor, respectively, of a construction or building. A railing 4 is raised along each of the two sides of the path of travel of the steps 3. A handrail 5 which rotates in the same direction as the steps 3 is guided by the railing 4. Of the plurality of steps 3, specific three steps 7–9 located next to one another are selected to form a special step group 6. In the special step group 6, an upper step 7 is selected as a reference step. The respective step boards of a middle step 8 and a lower step 9 of the particular step group can be elevated so that a horizontal surface is provided by the special step group 6 to carry a wheelchair 10.

Figure 3:
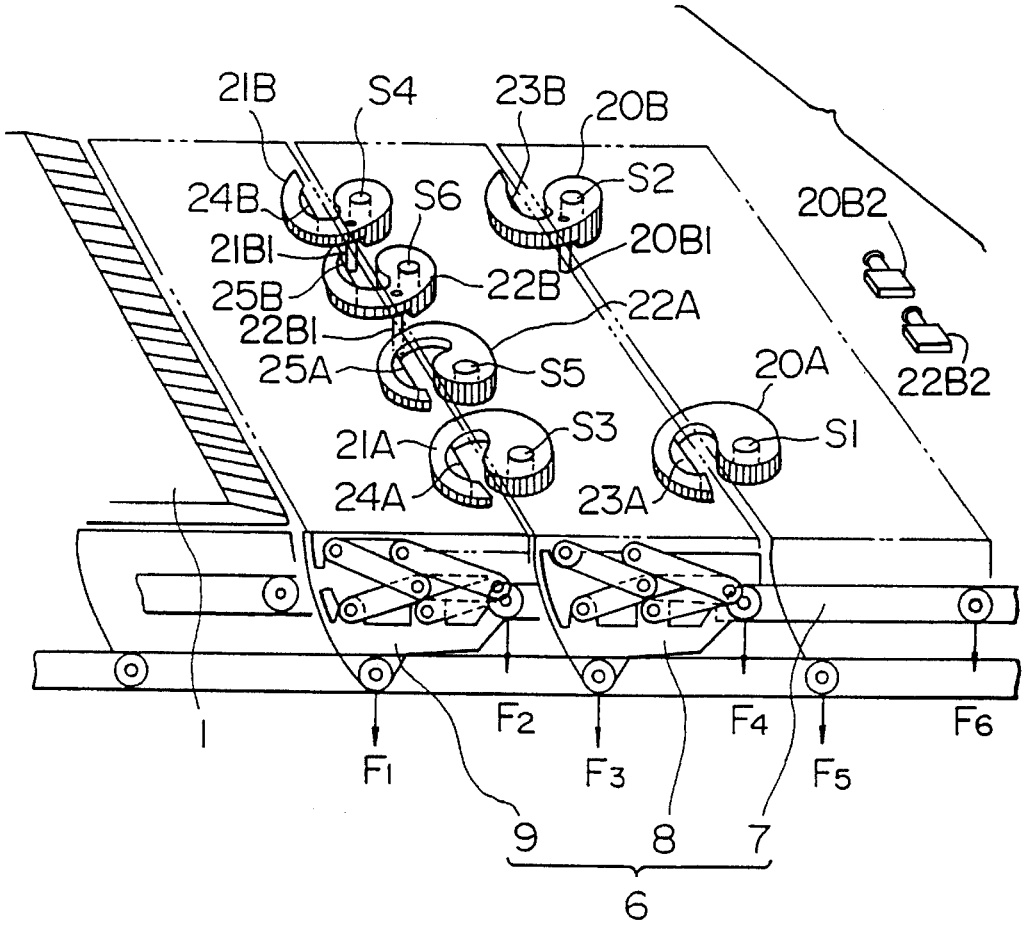
FIG. 3 shows in perspective view a coupling mechanism for a special step group of the escalator apparatus according to the present invention.
Figure 4:
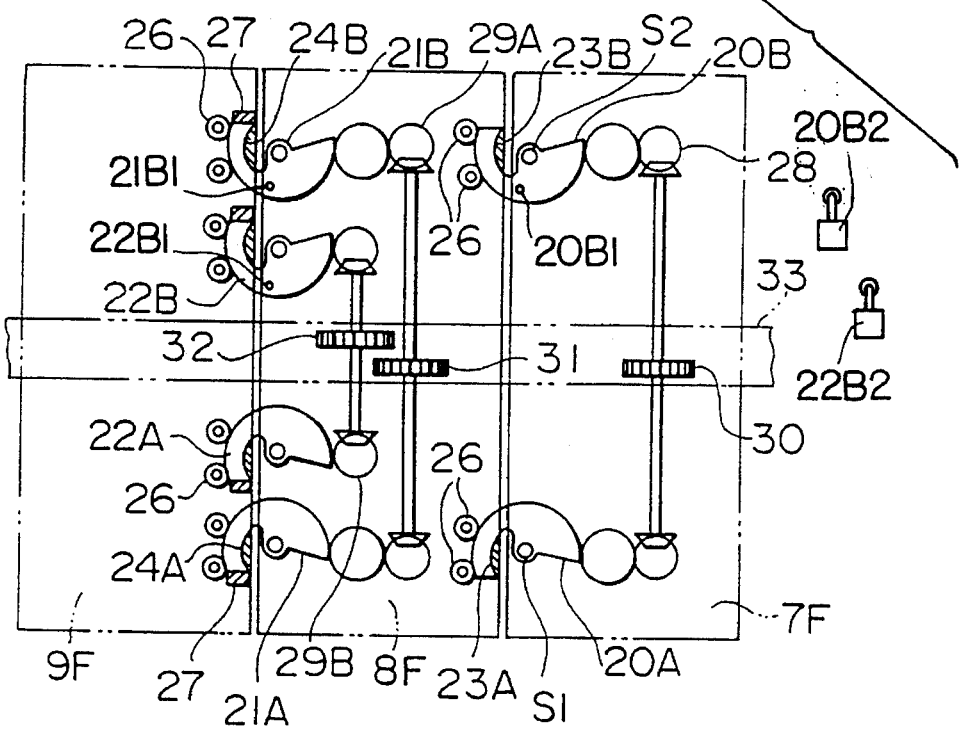
FIG. 4 is a top plan view showing a power transmission mechanism for the special step group of the escalator apparatus according to the present invention.
Figure 5:
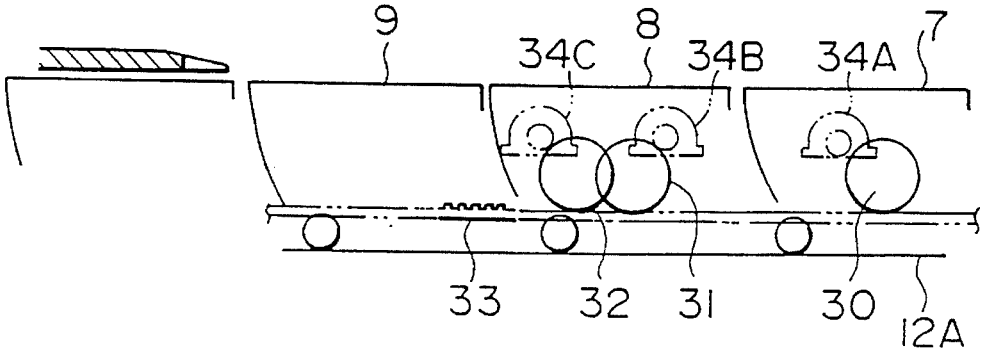
FIG. 5 is a side view showing the power transmission mechanism of the special step group of the escalator apparatus according to the present invention.

The actual construction and operation of the above described special step group will now be described with reference to FIG. 1 and FIGS. 3 to 8. The upper step 7, middle step 8 and lower step 9 of the special step group 6 are respectively provided with a fixed step board 7F and vertically movable step boards 8F and 9F and have front wheels 11A and rear wheels 11B rotatable between and guided by guide rails 12A and 12B which are fixed to a frame body constituting the fixed structure of the escalator. Further, the step boards 8F and 9F are supported through parallel linkages 14 and 15 on bases 12 and 13 on which the front wheels 11A and rear the wheels 11B are mounted. The parallel linkage 15 of the lower step 9 is formed by two sets of linkages, i.e., a first parallel linkage 15A and a second parallel linkage 15B with a middle base 13S interposed therebetween. Furthermore, coupling mechanisms 16 and 17 are provided between the step boards 7F, 8F and 9F to couple them together when a wheelchair is to be carried. A coupling mechanism 18 for coupling the base 12 of the middle step 8 and the middle base 13S of the lower step 9 is also provided. In addition, the lower step 9 is provided with a riser 19A attached to the base 13, a riser 19B attached to the middle base 13S and a riser 19C attached to the step board 9F, the three risers forming a triple superposed structure. On the other hand, the coupling mechanisms 16, 17 and 18 are constructed as shown in FIGS. 3 to 5. That is, when the steps 7 to 9 are horizontally positioned, a rack rotating mechanism is rotated by a motor energized by a built-in battery within a step or an external power supply, or by a rack mechanism and driving means within the steps, as shown in FIGS. 4 and 5. Fixing hooks 20A, 20B, 21A, 21B, 22A and 22B are thus rotated to fix the steps 7, 8 and 9 together against relative movements in vertical and forward-rearward directions.

When the steps 7, 8 and 9 are horizontally positioned at the lower (entrance or loading) portion or at the upper (exit or unloading) portion of the escalator, the vertical load from the wheelchair 10 does not act upon the fixing hooks 20A, 20B, 21A, 21B, 22A and 22B, so that it is easy to engage the fixing hooks. Further, the parallel linkages 14 and 15 which bear the moment generated by the load of the wheelchair 10 do not receive the load and are in their free state. Thus the load from the wheelchair 10 only acts upon the front wheels 11A and the rear wheels 11B of the steps 7, 8 and 9 as downward loads F1–F6. The fixing hooks 20A are 20B are pivotally supported by shafts S1 and S2 on the lower surface of the step board 7F and are rotatable into engagement with noses 23A and 23B provided on the adjacent step board 8F. The fixing hooks 21A and 21B are rotatably supported by the shafts S3 and S4 on the lower surface of the step board 8F and are rotatable to engage noses 24A and 24B provided on the adjacent step board 9F. Furthermore, the fixing hooks 22A and 22B are supported by shafts S5 and S6 on the base 12 of the step 8 and are rotatable to engage noses 25A and 25B provided on the middle base 13S of the adjacent step 9. It should be noted that no jolting is caused after such engagement since the free ends of the fixing hooks 20A, 20B, 21A, 21B, 22A and 22B are engaged with the respective noses 23A, 23B, 24A, 24B, 25A and 25B while they are inserted into the respective spaces formed between these noses and rollers 26 disposed adjacent the noses. Further, the state of engagement may be constantly maintained by a stopper 27 provided at the position corresponding to the terminal end of each fixing hook in its engaged position.

The mechanism for rotating the fixing hooks are drivingly connected to pinions 30–32 beneath the steps 7–9 by a group of power transmission gears 28, 29A and 29B, respectively. These pinions 30–32 are adapted to mesh with racks 34 arranged in parallel to the guide rails 12A, 12B. The racks 33 are disposed in the upper and lower horizontal portions of the escalator and raised into meshing engagement with the pinions 30–32 only when a wheelchair is to be carried. It should be noted that, instead of the racks 33, motors 34A–34C may be provided in the steps 7 and 8 to drive the pinions.

Figure 6:
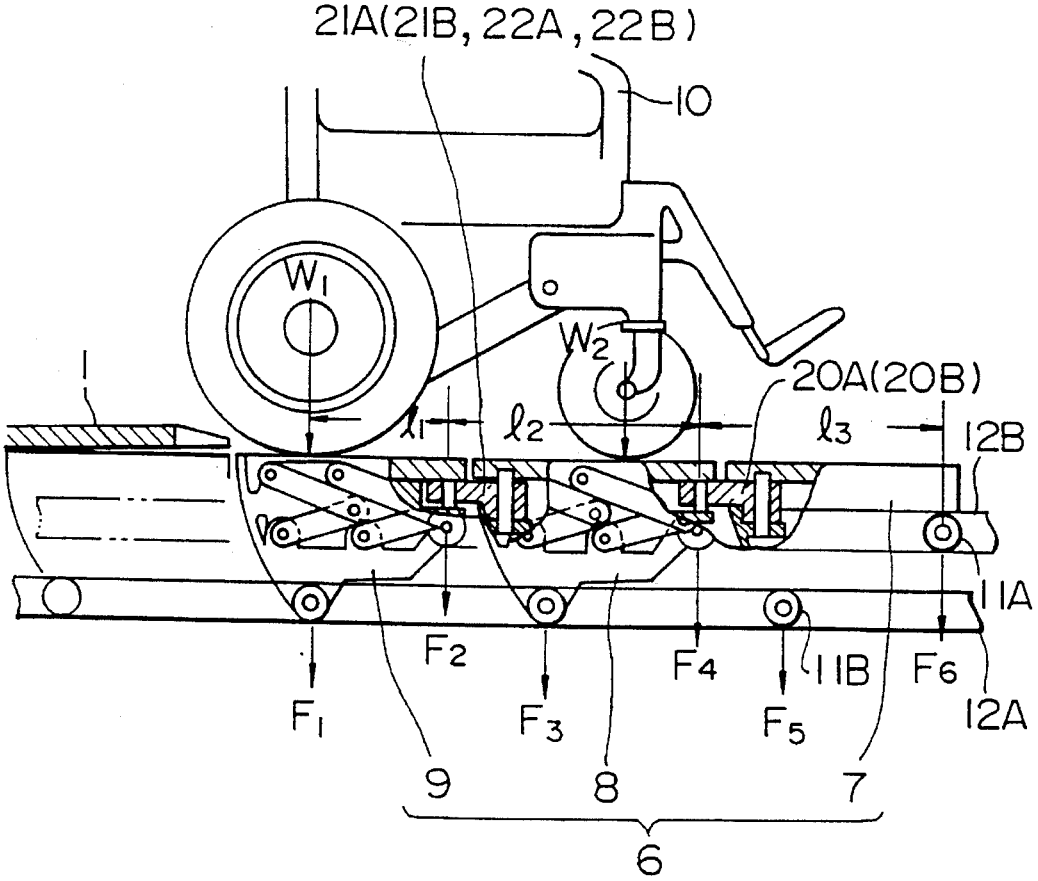
FIG. 6 is a side view of a part of the escalator apparatus according to the present invention with a wheelchair on the special step group of the apparatus.

FIG. 6 shows the state of carrying the wheelchair 10 when the steps 7–9 are in their horizontal state at an entrance/exit. In this state, the fixing hooks 20A–20B of the coupling mechanism are already engaged and extend over adjacent pairs of steps 7 and 8 and 8 and 9. At this time, loads $W_1$ and $W_2$ from the wheelchair 10 act directly upon the front wheels 11A and the rear wheels 11B, but do not act upon the above-described fixing hooks.

Figure 7:
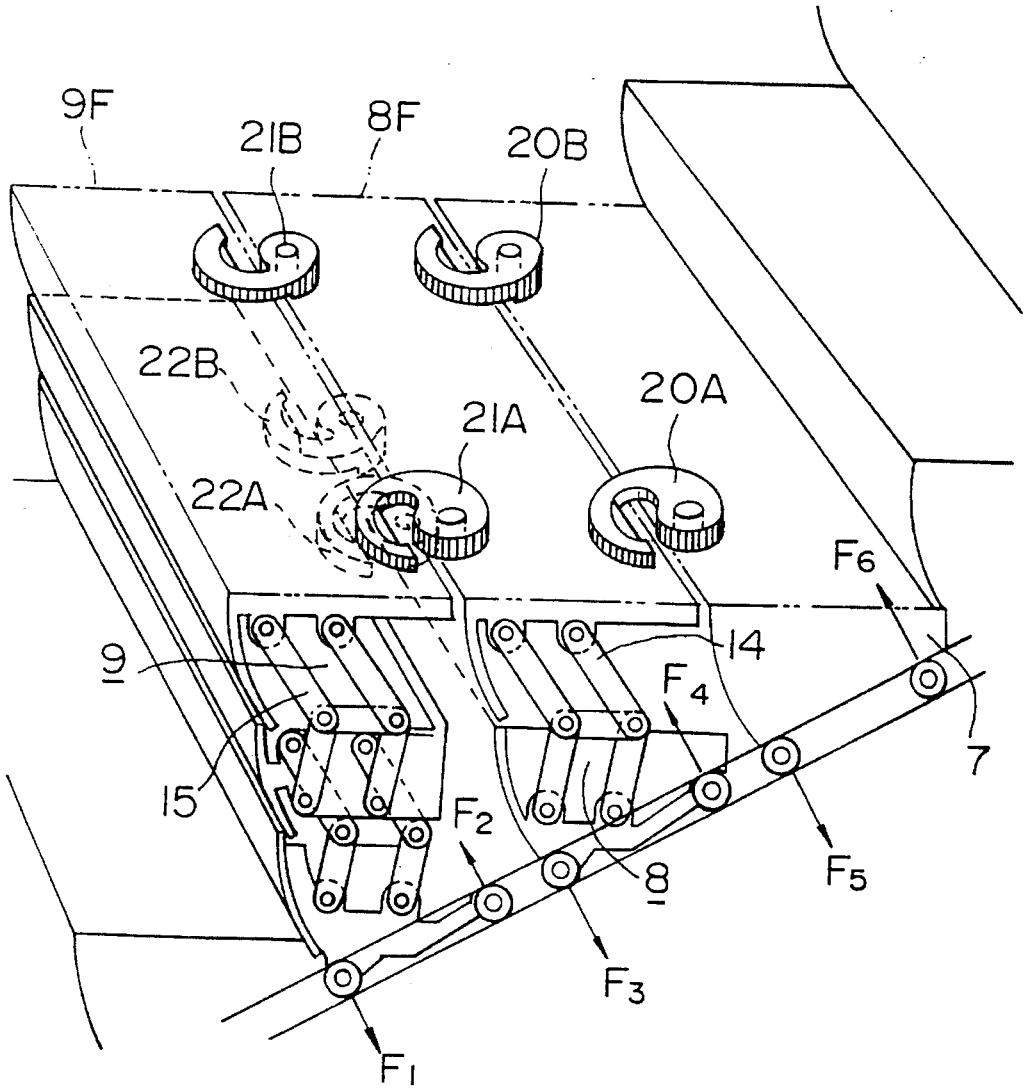
FIG. 7 is a perspective view showing respective mechanisms of the special step group at the sloping portion of the escalator apparatus according to the present invention.
Figure 8:
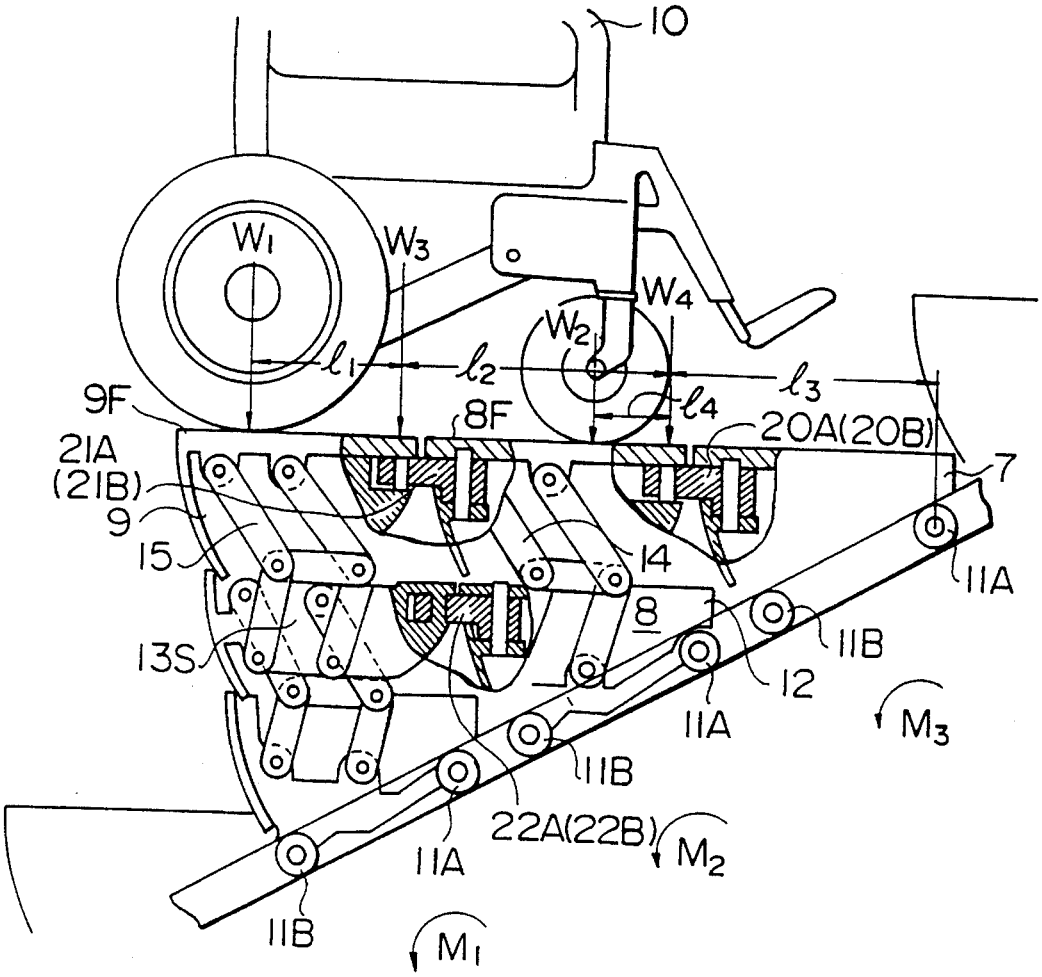
FIG. 8 is a perspective view of the special step group and a wheelchair thereon at the sloping portion of the escalator apparatus according to the present invention.

A description will now be given with respect to a case where the special step group carrying the wheelchair 10 is moved to the sloping portion of the escalator. As shown in FIGS. 7 and 8, the upper step 7 of the special step group receives loads $W_1$ and $W_2$ of the wheelchair 10 through the fixing hooks 20A–22B and the moment caused by said loads is carried by the parallel linkages 14 and 15 to distribute the loads to the respective front wheels 11A and rear wheels 11B of the steps 7–9. Loads on the front wheels 11A and rear wheels 11B are thus lowered to an allowable level. Specifically, the lower step 9 is heavily loaded by the wheelchair 10 in the case where the wheelchair is motor-operated and is heavy and large in size. Thus, the upper step 7 and the step board 8F of the middle step 8 are connected in an interlocked manner by means of the fixing hooks 20A and 20B. Further, an interlocked connection is made respectively between the step board 8F and the step board 9F of the lower step 9 by fixing hooks 21A and 21B and between the base 12 and the middle base 12S by the fixing hooks 22A and 22B. In this state, when the upper step 7 is displaced upward as it is moved to the sloped portion Of the escalator, the steps 8F and 9F connected to the upper step 7 by the fixing hooks 20A–22B are lifted. At this time, while the step boards 8F and 9F tend to be inclined about the fixing hooks 20A, 20B and 21A, 21B, the parallel linkages 14 and 15 are provided to prevent such inclination. That is, a moment $M_1=W_1 \times l_1$ is generated when the load $W_1$ by the wheelchair 10 acts upon the step board 9F of the lower step 9. Since this moment $M_1$ is transmitted to the parallel linkage 15, the moment is distributed to the front wheel 11A and the rear wheel 11B of the lower step 9. On the other hand, since the load $W_1$ is received by the fixing hooks 21A and 21B, the load $W_1$ acts as a load $W_3$ at the point of connection. Further, the load acting upon the step board 8F consists of the above-mentioned load $W_3$ and the load $W_2$ by the wheelchair 10. When these loads $W_2$ and $W_3$ act upon the step board 8F, a total moment $M_2$ consisting of a moment $W_3 \times l_2$ and a moment $W_2 \times l_4$ is generated. The moment $M_2$ is distributed to the front wheel 11A and the rear wheel 11B of the middle step 8. Further, the loads $W_2$ and $W_3$ are received as a load $W_4$ by the fixing hooks 20A and 20B. The upper step 7 is subjected to the load $W_4$, the weight of itself and a moment $M_3$ consisting of $W_4 \times l_3$. At this time, the respective front wheels 11A and rear wheels 11B of the steps 7–9 are subjected to loads $F_1$–$F_6$ (FIG. 7).

If it is desired to place a wheelchair on an escalator which is being operated in its usual manner, it is necessary to call a person in charge or to push an operation button provided in the vicinity of an entrance/exit to switch the operation of the escalator to an wheelchair carrying mode. When it is switched to the wheelchair carrying mode, the special step group 6 is stopped in front of the lower entrance 1. At this time, the respective step boards 7F, 8F and 9F of the upper step 7, the middle step 8 and the lower step 9 are horizontally arranged so that the wheelchair 10 can be loaded thereon. Upon detecting that the above described special step group 6 has been stopped at the predetermined position, the rack 33 shown in FIGS. 4 and 5 is raised and engaged with the pinions 30–32 incorporated into the steps 7 and 8.

Next, when the escalator is operated by pushing the operation button of the escalator, the pinions 30–32 meshed with the rack 33 are rotated as the steps 7 and 8 are moved. Such rotation is transmitted by the power transmission gear group 28, 29A and 29B to the fixing hooks 20A–22B to cause them to rotate into locking engagement with the noses 23A–25B of the adjoining step boards 8F and 9F and the middle base 13S. When the steps 7–9 are further moved and enter the sloped portion of the escalator, the upper step 7 is moved upward. At this time, the step boards 8F and 9F of the middle step 8 and the lower step 9 which are coupled to the upper step 7 are concurrently raised upward so that the parallel linkages 14 and 15 are extended. The steps are further moved through the sloped portion while maintaining their horizontal positions (FIG. 1, FIG. 2, FIG. 7, FIG. 8).

In this sloped portion, the step board 9F of the lower step 9 is to be raised by the amount equal to two steps. If nothing is done, a large gap is formed between the step board 9F and the base 13. In the present embodiment, however, the risers 19A–19C constructed in three-fold are provided to prevent the occurrence of such gap.

When the above described special step group 6 reaches the horizontal portion at a higher entrance/exit, the steps 7–9 are brought into the same level, so that the parallel linkages 14 and 15 are contracted. Thus, no difference in level is caused between the step boards 7F–9F. Stopping the special step group 6 at a predetermined position, the wheelchair 10 is moved to the upper entrance/exit and then removed therefrom. It should be noted that, after the special step group has arrived at the predetermined position, an upper rack (not shown) but similar to the rack 33 shown in FIG. 5, is raised, in a similar manner as at the lower entrance/exit 1, into engagement with the pinions 30–32 and the escalator is again operated in normal mode. The fixing hooks 20A–22B are rotated and disengaged to release the interlocking. This rising of the upper rack may be performed simultaneously with the rising of the lower rack at the lower entrance/exit. After the above described interlocking is released, the rack is lowered to assure that the rack is disengaged from the pinions 30–32 during normal operation of the escalator.

Many movable components are incorporated in the steps 7–9 to raise and lower the step boards 8F and 9F. If, among such movable components, the fixing hooks 20A–22B for example are not securely moved to their predetermined positions, the step boards 8F and 9F are displaced at the time of carrying a wheelchair to receive an excessive stress. In order to detect that each of the fixing hooks is displaced to its predetermined position, it is thus desirable to provide motion confirming bus 20B1, 21B1 and 22B1 movable with respective fixing hooks. Sensors 20B2 and 22B2 are provided for example on the frame of the escalator at a position corresponding to the displaced position of the motion confirming member to check the reliability of motion to perform safe operation.

Further, since the steps 8 and 9 provided with the movable step boards 8F and 9F are reversed in their high and low relationship on the returning side of the escalator. It is thus possible that the step boards 8F and 9F are separated from the bases 12 and 13 due to their own weight and are damaged upon their collision against the bottom of the frame body. Therefore, it is desirable to provide a holding mechanism which holds the step boards 8F and 9F at their predetermined positions during normal operation and releases them from the predetermined positions when a wheelchair is to be carried.

As has been described, according to the above embodiment, the three step boards 7F, 8F and 9F are maintained horizontally even at the sloped portion by the coupling mechanism for coupling the upper step 7 of the special step group 6 to the respective step boards 8F and 9F of the two remaining steps 8 and 9. It is thus possible to carry a large wheelchair without changing the construction of a conventional escalator.

Figure 9:
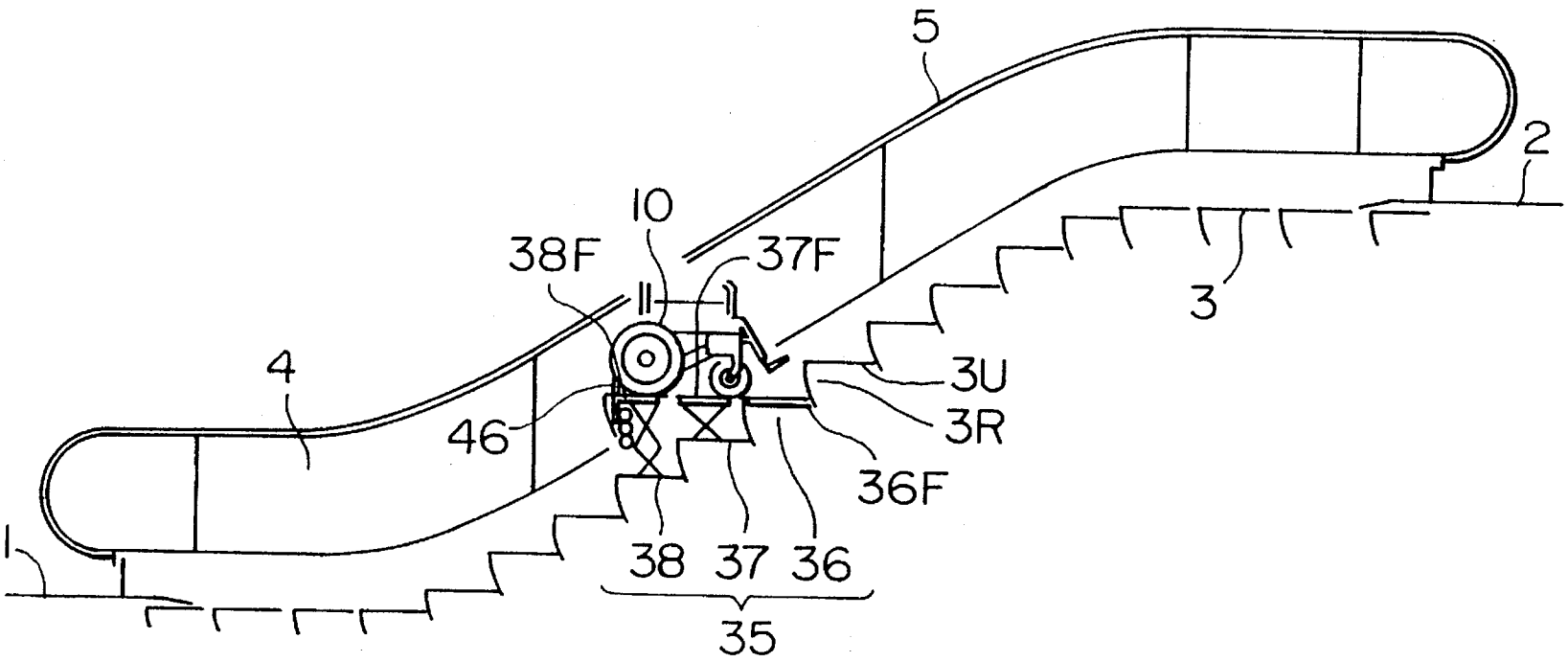
FIG. 9 is a schematic side view showing the entire modes of operation of the escalator apparatus according to another embodiment of the present invention.
Figure 10:
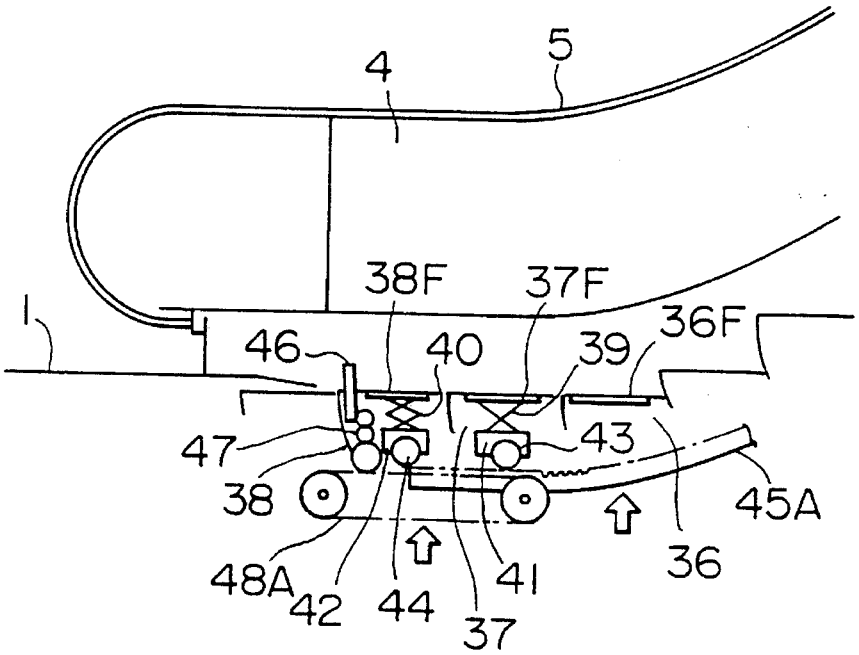
FIG. 10 is a schematic side view of a lower entrance/exit section of the apparatus according to the other embodiment of the present invention.
Figure 11:
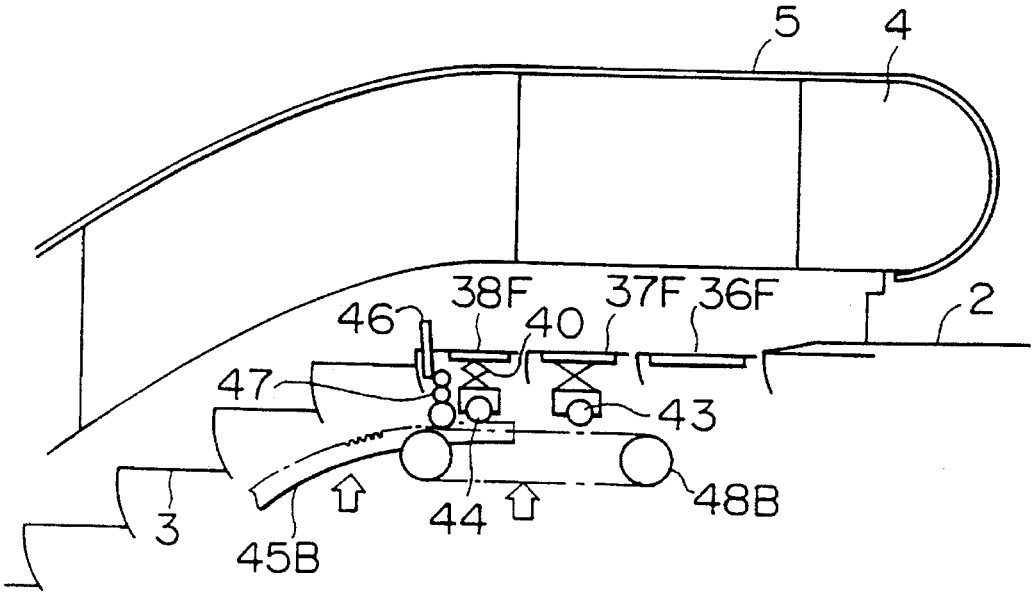
FIG. 11 is a schematic side view of an upper entrance/exit section of the escalator apparatus of the other embodiment of the present invention.

Another embodiment of the present invention will now be described with reference to FIGS. 9–11, wherein the reference numerals same as in FIGS. 1–8 indicate identical components and a. This embodiment is similar to the foregoing embodiment in that the respective step boards 37F and 38F of middle and lower steps 37 and 38 of a special step group 35 are raised to the same level as the step board of an upper step 36 when carrying a wheelchair to secure a surface for supporting the wheelchair and that the raising/lowering mechanisms for the step boards 37F and 38F are incorporated in the steps 37 and 38 to make it possible to transport a large size wheelchair or a handcart without changing the installation size of the escalator.

In the embodiment, the respective mechanisms for raising/lowering the step boards 37F and 38F are provided independently from each other in the steps 37 and 38. That is, the step boards 37F are 38F are provided on bases (not shown) equivalent to those in the foregoing embodiment and cross linkages 39 and 40 are so constructed as to be expanded/contracted by power from power transmission gear 41 and 42. The transmission gears 41 and 42 are to be driven by an external driving means. That is, when an instruction for wheelchair carrying operation is given, racks 45A and 45B located respectively at the upper and lower portions of the escalator between the sloped portion and the respective horizontal portions are raised in the direction of the arrows so that the rack 45A is engaged with the pinions 43 and 44 at the lower entrance/exit 1. If the escalator is operated in this state, since the rack 45A is not moved, the pinions 43 are 44 are rotated and the rotating force thereof causes the cross linkages 39 and 40 to be raised through the power transmission gears 41 and 42 so that the step boards 36F–38F of the steps 36–37 are placed in the same level. The steps 37 and 38 after being disengaged from the rack 45A are continued to be moved with the cross linkages 39 and 40 in their raised state. When the pinions 43 and 44 are engaged with the rack 45B at the upper portion, the cross linkages 39 and 40 are lowered as shown in FIG. 11. Before the normal operation is restored, the racks 45A and 45B are lowered to their regular positions.

It should be noted that a wheel stopper 46 projects from the step board 38F of the step 38 and is vertically movable by a power transmission gear 47 incorporated into the step 38. The lower portion of the power transmission gear 47 is engaged by a rack raised from its regular position or by driving chains 48A and 48B. At the side of the lower entrance/exit, therefore, after a wheelchair 10 is placed on the special step group, the wheel stopper 46 is caused to protrude by the operation of the power chain 48A and the escalator is operated in this state. On the other hand, at the upper entrance/exit 2, the power chain 48B is operated after the wheelchair 10 is removed from the escalator to lower the wheel stopper 46. Further, when a wheelchair 10 is to be loaded at the upper entrance/exit 2, the wheel stopper 46 is caused to protrude before the loading. During the movement of the escalator, a stopper is formed by the wheel stopper 46 and a riser 3R of an upper step 3U which is adjacent to the special step group 35. It is thus possible to safely carry the wheelchair 10 by retaining it within the range of the special step group 35.

Further, since the steps 37 and 38 are independent from the step 36, the arrangement of the preceding embodiment may be incorporated into the present embodiment, if necessary, to assure a safe operation.

Figure 12:
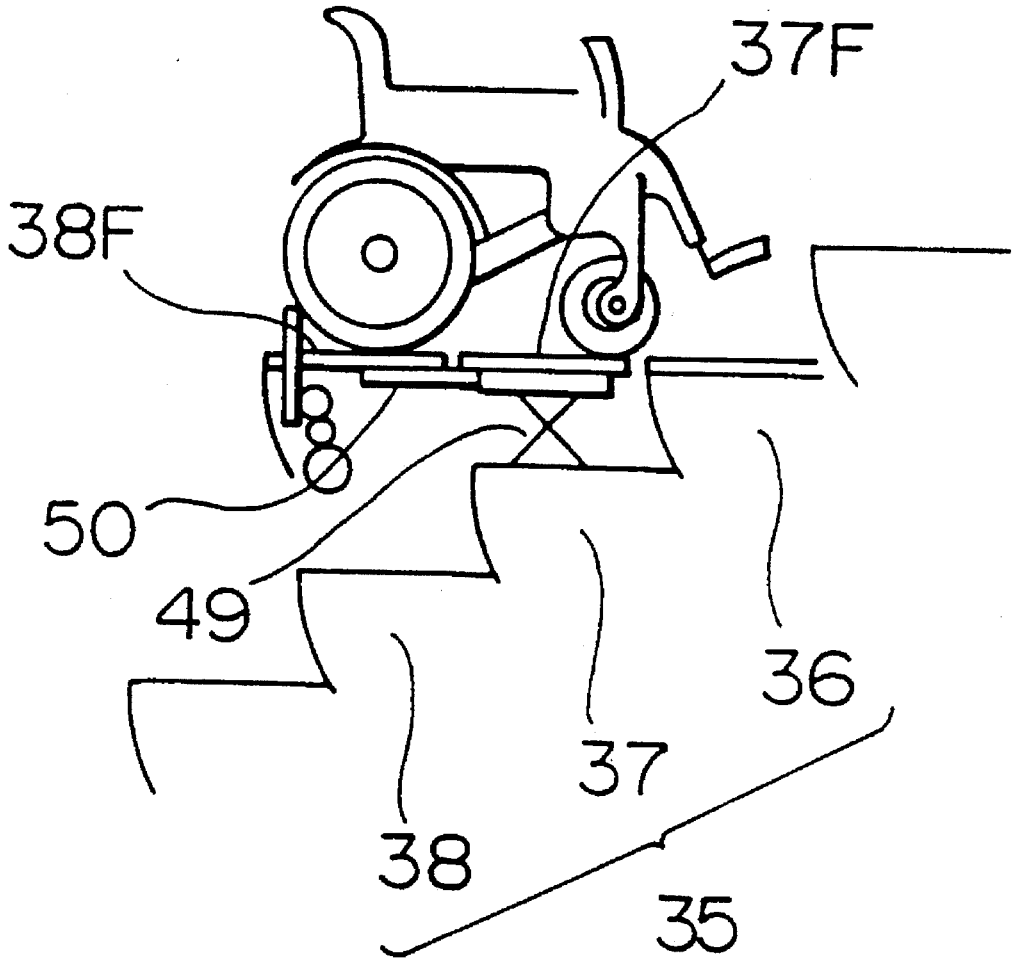
FIG. 12 is a schematic side view of a wheelchair carried by the escalator apparatus of the other embodiment of the present invention.

FIG. 12 shows another embodiment according to the present invention, in which only a middle step 37 of the special step group 35 is provided with a raising/lowering mechanism 49 for raising/lowering a step board 37F. A step board 38F of a lower step 38 is raised/lowered by a supporting rod 50 which projects from the step board 37F.

As has been described, the present invention provides an escalator apparatus which can carry a large size wheelchair of a handcart and which can be installed in a conventional installation size.

What is claimed is:

1. An escalator apparatus comprising:

a plurality of steps so connected as to form an endless loop and being movable along a sloping portion of the escalator apparatus;

said plurality of steps including two adjacent steps having special step boards which can be displaced upwardly;

each special step board of said special step boards being located at a predetermined position with a difference in level provided between the special step board and a step board of an adjacent step when the escalator apparatus is in a usual operation and said special step boards are positioned in said sloping portion of the escalator apparatus; and each special step board of said special step boards being located at a position displaced upwardly away from said predetermined position of the special step board and being substantially the same in level as a step board of an upper step adjacent to the upper one of said special step boards when the escalator apparatus is an a wheelchair carrying operation and said special step boards are positioned in said sloping portion of the escalator.

2. An escalator apparatus comprising:

a plurality of steps so connected as to form an endless loop and being movable along a sloping portion of the escalator apparatus;

said plurality of steps including two adjacent steps having special step boards which can be displaced upwardly; and a displacing means operable during a wheelchair carrying operation of the escalator apparatus;

said displacing means being operative to upwardly displace each of said special step boards, with said special step boards kept in substantially horizontal positions, away from predetermined positions to an elevated position which is substantially the same in level as a step board of an upper step adjacent the upper one of said special step boards when the escalator apparatus is in the wheelchair carrying operation and said special step boards are positioned in said sloping portion of the escalator apparatus.

3. An escalator apparatus comprising:

a plurality of normal steps so connected as to form an endless loop and being movable along a sloping portion of the escalator apparatus, wherein said plurality of normal steps include two adjacent steps having special step boards which can be displaced upwardly;

each special step board of said special step boards is so arranged as to be displaced upwardly away from its predetermined position: and a maintaining means is provided to displace each of said special step boards from said predetermined position to an elevated position which is substantially the same in level as a step board of an upper step disposed adjacent to the upper one of said special step boards when the escalator apparatus is in a wheelchair carrying operation and said special step boards are positioned in said sloping portion of the escalator, said maintaining means being also operative to maintain the thus displaced special step boards and said step board of said upper step in horizontal positions;

said maintaining means being disposed between said special step boards and said step board of said upper step.

4. An escalator apparatus comprising:

a plurality of steps so connected as to form an endless loop and being movable along a sloping portion of the escalator apparatus, wherein said plurality of steps include a plurality of special steps disposed in said endless loop in an adjacent relationship, said special steps having special step boards each of which can be displaced upwardly away from its predetermined position when said special steps are positioned in said sloping portion of the escalator; and said special step boards are so arranged as to cooperate with a step board of an upper step adjacent to the uppermost one of said special steps to form a wheelchair carrying surface during a wheelchair carrying operation of the escalator apparatus.

5. An escalator apparatus comprising:

a step;

a plurality of special steps disposed adjacent to said step at a lower side thereof and having displaceable step boards each of which can be displaced upwardly from its predetermined position; and a displacing means accommodated in steps including said special steps and being operative to displace said displaceable step boards upwardly;

said displacing means being actuated during a wheelchair carrying operation of the escalator apparatus by relative movement between said step and a fixed member of the escalator apparatus to displace said displaceable step boards to elevated positions substantially the same in level as a step board of an upper step adjacent the uppermost one of said special steps whereby at least three step boards comprising said displaceable step boards and said step board of said upper step are positioned substantially horizontally in a substantially contiguous relationship.

6. An escalator apparatus comprising:

a reference step; and a plurality of special steps disposed adjacent to said reference step at a lower side thereof and having special step boards each of which can be displaced upwardly away from a predetermined position of said each special step board;

said special step boards and a step board of said reference step being capable of being positioned in substantially horizontal positions at an entrance of the escalator apparatus and movable toward an exit of the escalator apparatus while said special step boards and said step board of said reference step are maintained in the horizontal positions.

7. An escalator apparatus including a plurality of steps having step boards adapted to be positioned in substantially the same level to provide a wheelchair carrying surface when said steps are moved along a sloping portion of the escalator apparatus, wherein said plurality of steps comprise:

a first step;

a second step disposed adjacent to said first step at a lower side thereof and having a step board which can be displaced upwardly away from its predetermined position a distance substantially equal to the height of one step; and a third step disposed adjacent to said second step at a lower side thereof and having a step board which can be displaced upwardly away from its predetermined position a distance substantially equal to a total of the heights of two steps.

8. An escalator apparatus including a plurality of steps having step boards adapted to be positioned in substantially the same level to provide a wheelchair carrying surface when said steps are moved along a sloping portion of the escalator apparatus, wherein said plurality of steps comprise:

a first step having a first base movable along a guide rail and a step board fixed to said first base;

a second step disposed adjacent to said first step at a lower side thereof and having a second base movable along said guide rail and a second step board which is supported on said second base and can be displaced upwardly away from its predetermined position a distance substantially equal to the height of one step; and a third step disposed adjacent to said second step at a lower side thereof and having a third base movable along said guide rail and a third step board which is supported on said third base and can be displaced upwardly away from its predetermined position a distance substantially equal to a total of the heights of two steps;

said first step having a means for connecting said first step to the step board of said second step;

said second step having a means for connecting said second step to the step board of said third step and for connecting said second step to an intermediate base of said third step.

9. An escalator apparatus including:

three steps disposed in an adjacent relationship; and a means for upwardly displacing step boards of the two lower steps of said three steps away from predetermined positions of the step boards of said two lower steps to raised positions substantially the same in level as a step board of the uppermost step of said three steps and for maintaining the step boards of said two lower steps at said raised positions when the escalator apparatus is in a wheelchair carrying operation and said three steps are positioned in a sloping portion of the escalator apparatus.

10. An escalator apparatus including three adjacent steps, wherein said three adjacent steps are structured such that, in each of an upper entrance/exit portion and a lower entrance/exit portion of the escalator apparatus, step boards of said three adjacent steps are held in substantially horizontal positions to provide a substantially horizontal and continuous surface of a dimension, measured in the longitudinal direction of the escalator apparatus, which is substantially equal to three times the dimension of each step board measured in said direction, and said step boards of said three adjacent steps are movable along an inclined section of the escalator apparatus between said upper and lower entrance/exit portions while said step boards of said three adjacent steps are maintained in the horizontal positions, and wherein a difference in height is provided between the substantially horizontal and continuous surface and each of step boards of normal steps disposed adjacent to the substantially horizontal and continuous surface on the upper and lower sides thereof when said step boards of said three adjacent steps are being moved along said inclined section of the escalator.

11. An escalator apparatus including three adjacent steps, wherein said three adjacent steps are structured such that, in each of an upper entrance/exit portion and a lower entrance/exit portion of the escalator apparatus, step boards of said three adjacent steps are held in substantially horizontal positions to provide a substantially horizontal and continuous surface of a dimension, measured in the longitudinal direction of the escalator apparatus, which is substantially equal to three times the dimension of each step board measured in said direction, and said step boards of said three adjacent steps are movable along an inclined section of the escalator apparatus between said upper and lower entrance/exit portions while said step boards of said three adjacent steps are maintained in the horizontal positions, and wherein the substantially horizontal and continuous surface is arranged to carry a wheel-chair from one of a lower floor to an upper floor and from the upper floor to the lower floor.

12. An escalator apparatus including steps having step boards upwardly displaceable to provide a wheel-chair carrying surface and being movable along an inclined section of the escalator apparatus while said step boards are held to maintain said wheel-chair carrying surface, wherein a step board lifting means is provided for upwardly displacing step boards of two steps so that step boards of three adjacent steps are positioned in a substantially horizontal plane to provide said wheel-chair carrying surface, wherein said step board lifting means is so dimensioned as to be accommodated between a step board guide rail and a step board when the latter step board is positioned in an entrance/exit portion of the escalator, and wherein a difference in height is provided between said wheel-chair carrying surface and each of step boards of normal steps disposed adjacent to said wheel-chair carrying surface on the upper and lower sides thereof when said wheel-chair carrying surface suitable to have a wheel-chair carried thereon is positioned in said inclined section of the escalator.

* * * * *